US011491410B2

(12) United States Patent
Carsello

(10) Patent No.: US 11,491,410 B2
(45) Date of Patent: Nov. 8, 2022

(54) TOY WITH INTERCHANGEABLE PARTS HAVING SELECTIVELY ENGAGEABLE FASTENERS

(71) Applicant: FUNKO, LLC, Everett, WA (US)

(72) Inventor: Thomas M. Carsello, Bothell, WA (US)

(73) Assignee: Funko, LLC, Everett, WA (US)

( * ) Notice: Subject to any disclaimer, the term of this patent is extended or adjusted under 35 U.S.C. 154(b) by 268 days.

(21) Appl. No.: 16/796,537

(22) Filed: Feb. 20, 2020

(65) Prior Publication Data

US 2021/0205719 A1 Jul. 8, 2021

Related U.S. Application Data

(60) Provisional application No. 62/961,502, filed on Jan. 15, 2020, provisional application No. 62/957,769, filed on Jan. 6, 2020.

(51) Int. Cl.
*A63H 3/28* (2006.01)
*A63H 3/16* (2006.01)

(52) U.S. Cl.
CPC ..... *A63H 3/28* (2013.01); *A63H 3/16* (2013.01)

(58) Field of Classification Search
CPC . A63H 3/16; A63H 3/28; A63H 33/04; A63H 33/06; A63H 33/062; A63H 33/08; A63H 33/086; A63H 33/088
USPC ..... 446/100, 102, 117, 120, 121, 122, 124, 446/128, 297
See application file for complete search history.

(56) References Cited

U.S. PATENT DOCUMENTS 3,236,004 A * 2/1966 Christiansen ..... A63H 33/042 446/128
3,375,604 A * 4/1968 Alonso ..... A63H 3/16 446/92
3,713,248 A * 1/1973 Heubl ..... A63H 33/042 446/128
4,026,065 A * 5/1977 Dick ..... A63H 33/108 446/121
4,651,458 A * 3/1987 Lanius ..... A01M 31/06 446/99

(Continued)

FOREIGN PATENT DOCUMENTS

JP H0727994 6/1995

OTHER PUBLICATIONS

ISA, PCT Application No. PCT/US2021/012082, International Search Report and Written Opinion dated Apr. 22, 2021, 8 pages.

*Primary Examiner* — Joseph B Baldori
(74) *Attorney, Agent, or Firm* — Perkins Coie LLP

(57) ABSTRACT

Toys having interchangeable parts are disclosed herein. In some embodiments, a toy includes two or more toy components or modules that can be releasably coupled together. Each toy component can include a (i) a body defining a sound-reflecting chamber having an opening and (ii) a fastener assembly coupled to the body. The fastener assembly can include a base and a fastener positioned in a recess of the base. The base can be positioned over the opening of the sound-reflecting chamber and coupled to the body. The fastener is configured to generate sound when the fastener is engaged to and/or disengaged from the mating fastener of another toy component, and the sound-reflecting chamber is configured to reflect the sound out of the body.

20 Claims, 7 Drawing Sheets

(56) References Cited

U.S. PATENT DOCUMENTS

| | | | | |
|---|---|---|---|---|
| 4,869,701 | A * | 9/1989 | Kawai | G09B 1/36 446/99 |
| 5,232,369 | A * | 8/1993 | Mavrikis | G09B 23/34 446/296 |
| 5,788,554 | A * | 8/1998 | Goodwin | A63H 3/46 446/99 |
| 5,897,417 | A | 4/1999 | Grey | |
| 7,144,179 | B2 * | 12/2006 | Varner | G09B 23/34 403/DIG. 1 |
| 9,174,137 | B2 * | 11/2015 | Palmer | A63H 3/02 |
| 9,227,147 | B2 * | 1/2016 | Kim | H01F 7/0221 |
| 10,814,241 | B2 * | 10/2020 | Kapeter | A63H 33/086 |
| 10,881,976 | B2 * | 1/2021 | Bobrikov | A63H 33/046 |
| 11,141,674 | B2 * | 10/2021 | Zenevics | A63H 33/062 |
| 2007/0254555 | A1 * | 11/2007 | Johnson | A63H 3/46 446/369 |
| 2013/0143467 | A1 | 6/2013 | Maggiore et al. | |
| 2013/0330997 | A1 | 12/2013 | Ryaa | |
| 2015/0258463 | A1 | 9/2015 | Park | |
| 2019/0111354 | A1 * | 4/2019 | Louie | A63H 3/46 |
| 2020/0289951 | A1 * | 9/2020 | Karsten | A63H 3/46 |

* cited by examiner

TOY WITH INTERCHANGEABLE PARTS HAVING SELECTIVELY ENGAGEABLE FASTENERS

CROSS REFERENCE TO RELATED APPLICATIONS

This application claims priority to (i) U.S. Provisional Patent Application No. 62/957,769, titled "APPARATUS FOR REMOVABLE FASTENING AND METHODS OF RETENTION," and filed Jan. 6, 2020; and (ii) U.S. Provisional Patent Application No. 62/961,502, titled "APPARATUS FOR REMOVABLE FASTENING AND METHODS OF RETENTION," and filed Jan. 15, 2020; each of which is incorporated herein by reference in its entirety.

TECHNICAL FIELD

The present technology is related to selectively engageable fasteners and, more particularly, to toys including different modules or components that can be interchangeably assembled together using selectively engageable fasteners.

BACKGROUND

Toys are popular with both children and adults. Some toys include parts like components or modules that can be attached to and detached from one another in a variety of combinations. The components and modules of such toys can include fasteners that facilitate the attachment/detachment of the parts from one another. Typically, such fasteners generate little or no sound during attachment/detachment due to sound damping effects from the materials to which the fasteners are affixed, as well as from the manner in which the fasteners are secured to the materials. Moreover, the fasteners are often susceptible to failure after repeated mechanical attachment/detachment, shortening the functional lifetime of the toy.

BRIEF DESCRIPTION OF THE DRAWINGS

Many aspects of the present technology can be better understood with reference to the following drawings. The components in the drawings are not necessarily to scale. Instead, emphasis is placed on clearly illustrating the principles of the present technology.

DETAILED DESCRIPTION

Figure 1A:
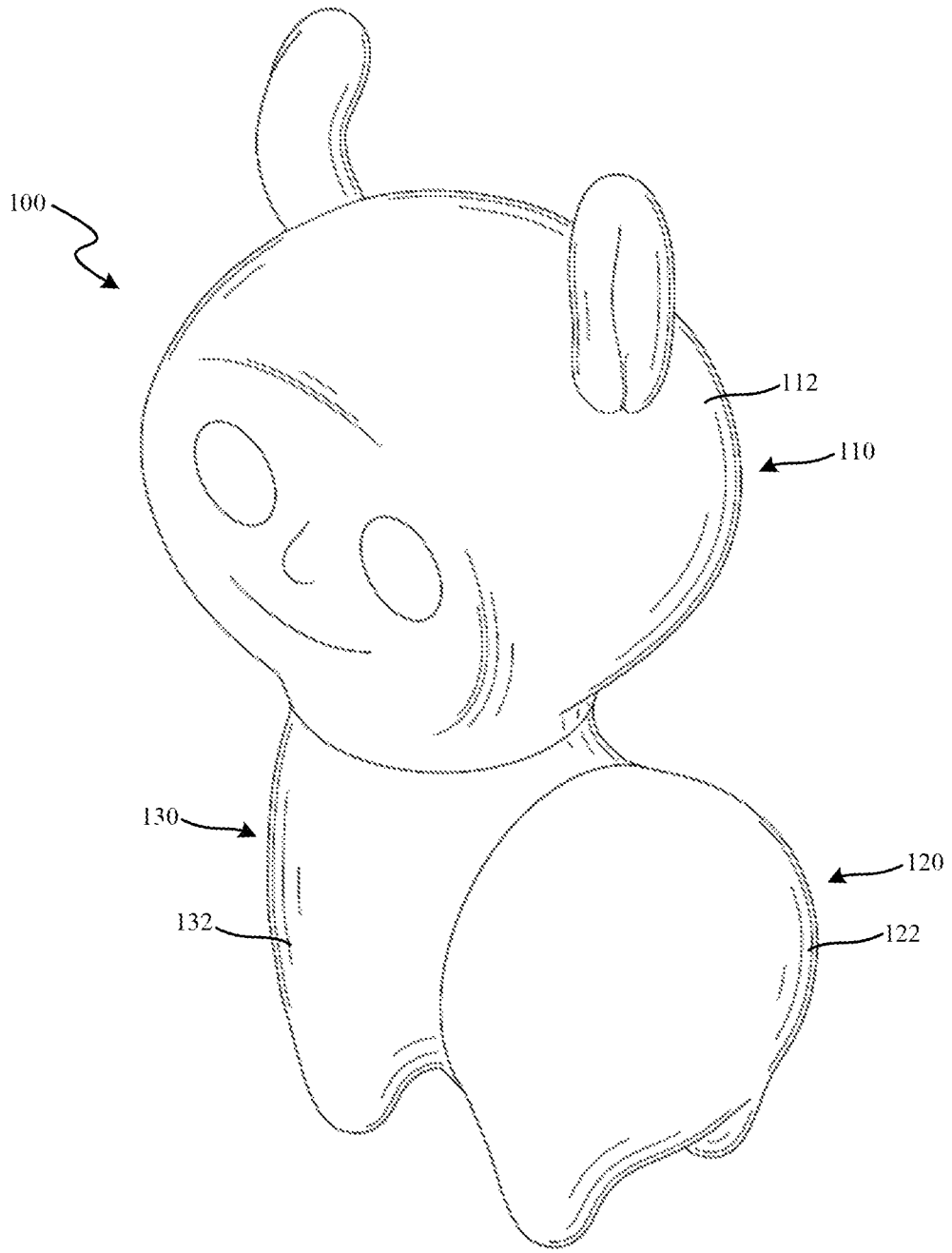
FIGS. 1A-1C are an isometric view, a cross-sectional side view, and an exploded isometric view, respectively, of a toy with interchangeable modules configured in accordance with embodiments of the present technology.

The present technology is directed generally to toys with interchangeable elements, components, or modules. The toys may preferably be formed primarily from plastics, metals, and/or other non-fabric-like materials. In some embodiments, for example, a toy includes two or more toy components or assemblies that can be releasably coupled together. The toy components can have different shapes/configurations such that the toy resembles, as non-limiting examples, a character, animal, person, automobile, or combinations thereof when the toy components are coupled together. Each toy component can include a (i) a body defining a chamber or housing capable of reflecting sound and having an opening and (ii) a fastener assembly coupled to the body over or substantially over the opening. The fastener assembly can include a base and a fastener positioned in a recess of the base. The base can be positioned over the opening of the sound-reflecting chamber. The fastener assembly is configured to generate sound (e.g., an audible "clicking" or other sound) when the fastener is attached to and/or detached from the fastener of another toy component, and the sound-reflecting chamber is configured to reflect the sound out of the body.

In one aspect of the present technology, the sound generated by the engagement and/or disengagement of the fastener is amplified by the configuration and disposition of the base relative to the body of each toy component. Conventional fasteners, such as snap-fit fasteners, are typically attached directly to or in direct contact with a solid structure or fabric-like materials such that a large portion of acoustic waves generated by coupling/decoupling of the fasteners is absorbed and damped by the structure. In contrast with such conventional arrangements, fastener assemblies configured in accordance with the present technology may be configured such that the base spans across the opening of the sound-reflecting chamber and the fastener is positioned substantially over the opening. Moreover, in some embodiments the base can include a plurality of standoff features that couple the base to the body of the toy component and that are the only components of the base that contact the body, thereby reducing the area of contact between the fastener and the structure to minimize sound damping effects. Accordingly, acoustic waves generated when the fastener is attached to and/or detached from the fastener of another toy component can easily propagate through the base and into the sound-reflecting chamber where they are reflected out of the corresponding toy component. Thus, modular toys configured in accordance with the present technology are expected to generate relatively loud sounds that may be satisfying to a user (e.g., a child playing with the toy) when the user couples or decouples the toy components from one another.

Specific details of several embodiments of the present technology are described herein with reference to FIGS. 1A-5B. The present technology, however, may be practiced without some of these specific details. In some instances, well-known structures and techniques often associated with the disclosed modular toys, snap-fit buttons, snap-fit connectors, etc., have not been shown in detail so as not to obscure the present technology. The terminology used in the description presented below is intended to be interpreted in its broadest reasonable manner, even though it is being used in conjunction with a detailed description of certain specific embodiments of the disclosure. Certain terms may even be emphasized below; however, any terminology intended to be interpreted in any restricted manner will be overtly and specifically defined as such in this Detailed Description section.

The accompanying Figures depict embodiments of the present technology and are not intended to be limiting of its scope. The sizes of various depicted elements are not necessarily drawn to scale, and these various elements may be arbitrarily enlarged to improve legibility. Component details may be abstracted in the Figures to exclude details such as position of components and certain precise connections between such components when such details are unnecessary for a complete understanding of how to make and use the present technology. Many of the details, dimensions, angles, and other features shown in the Figures are merely illustrative of particular embodiments of the disclosure. Accordingly, other embodiments can have other details, dimensions, angles, and features without departing from the spirit or scope of the present technology.

Figure 1B:
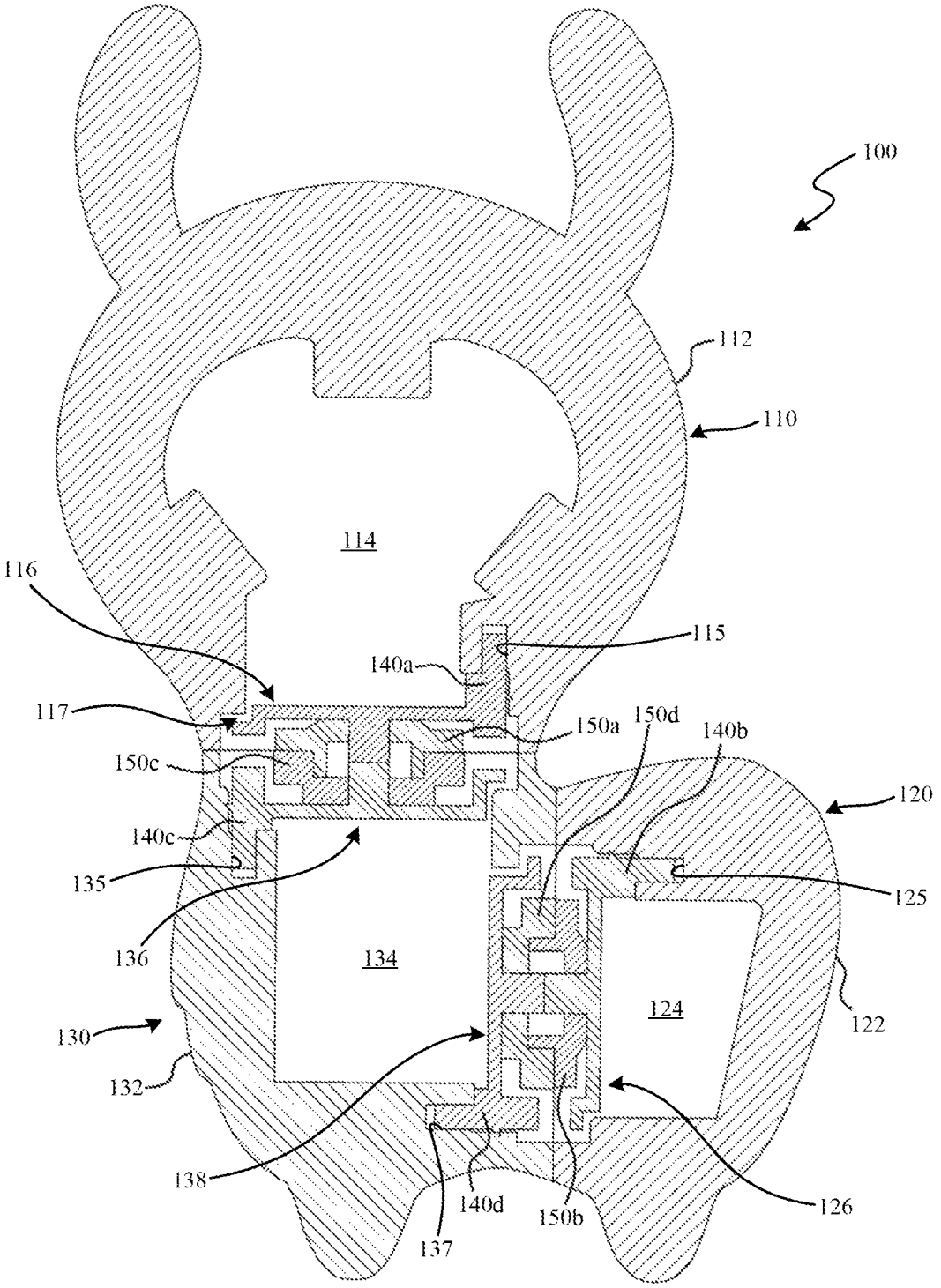
Figure 1C:
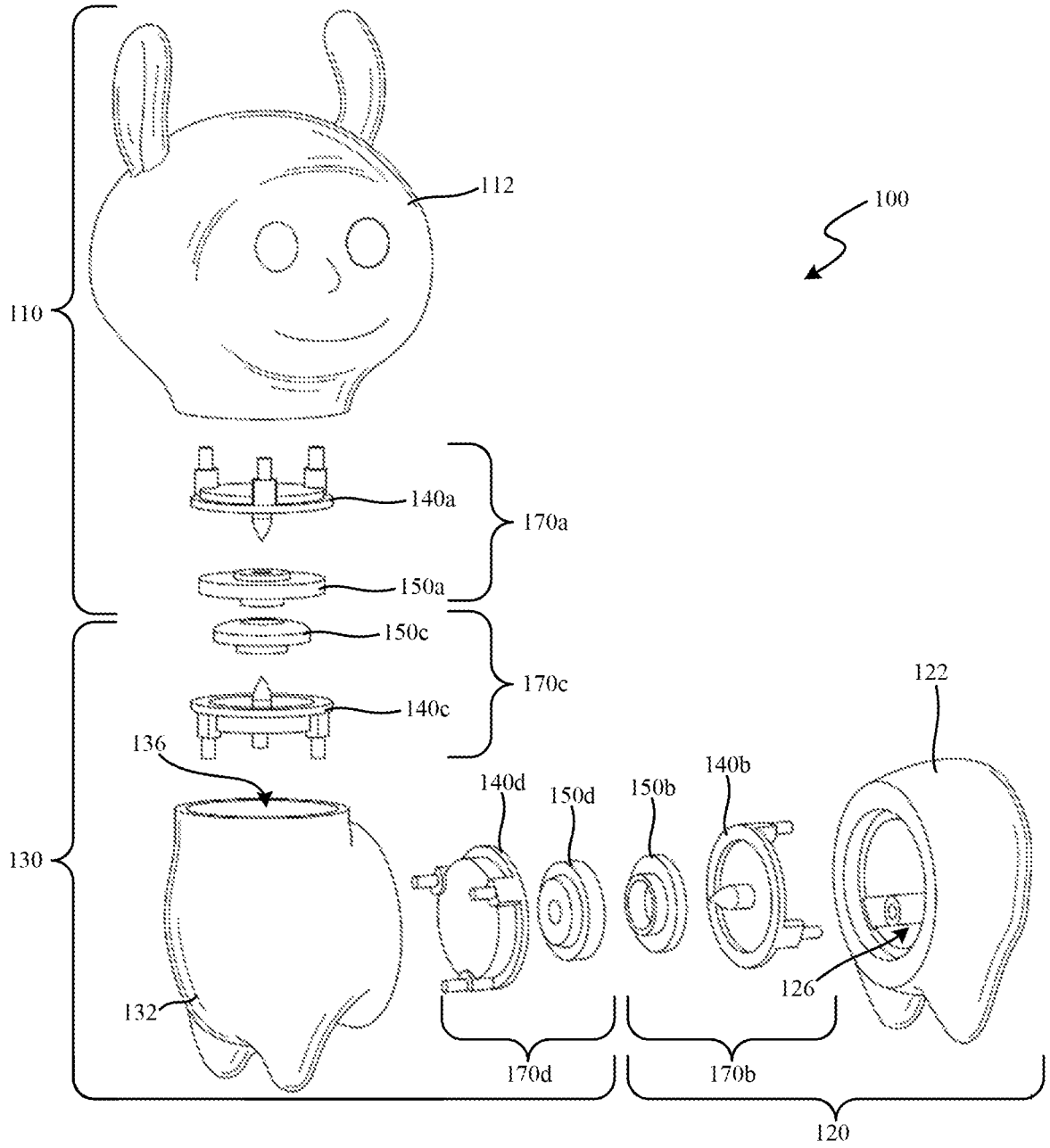

FIGS. 1A-1C are an isometric view, a cross-sectional side view, and an exploded isometric view, respectively, of a modular toy 100 configured in accordance with embodiments of the present technology. Referring to FIGS. 1A-1C together, the toy 100 can include a first toy component 110 and a second toy component 120 that can each be releasably coupled/fastened/attached to a third toy component 130. The first, second, and third toy components 110, 120, 130 (collectively "toy components 110-130") include housings or bodies 112, 122, 132, respectively (collectively "bodies 112-132"), that are shaped, colored, textured, etc., such that the toy 100 resembles a character, animal, person, automobile, other selected toy design, or combinations thereof when the toy components 110-130 are coupled together. In the illustrated embodiment, for example, the toy 100 is generally shaped as an animal (e.g., a llama) in which (i) the first body 112 is shaped as the head of the animal, (ii) the second body 122 is shaped as a back portion of the body of the animal, and (iii) the third body 132 is shaped as a front portion of the body of the animal. In other embodiments, the toy 100 can include additional or fewer components, elements or modules that can be releasably coupled together. In yet other embodiments, the toy 100 can include additional or fewer components, elements or modules that utilize the fastener assemblies disclosed herein together with a housing or structure without a chamber or a sound-reflecting chamber.

As best seen in FIG. 1B, (i) the first body 112 defines a first chamber 114 (e.g., a sound-reflecting chamber) having a first opening 116, (ii) the second body 122 defines a second chamber 124 having a second opening 126, and (iii) the third body 132 defines a third chamber 134 having a third opening 136 and a fourth opening 138. Accordingly, the bodies 112-132 can be generally hollow. The bodies 112-132 can be formed from plastic, metal, and/or materials and can be integrally formed (e.g., molded as single parts) or otherwise manufactured.

As best been in FIG. 1C, each of the toy components 110-130 can include a fastener assembly 170 (identified individually as first through fourth fastener assemblies 170*a-d*) including a base 140 (identified individually as first through fourth bases 140*a-d*) and a fastener 150 (identified individually as first through fourth fasteners 150*a*-150*d*) coupled to the base 140. As an example, the fasteners 150 may be conventional snap fasteners. More specifically, in the illustrated embodiment the first base 140*a* is secured to the first body 112 over the first opening 116 and the first fastener 150*a* is coupled to the first base 140*a*. Similarly, the second base 140*b* is secured to the second body 122 over the second opening 126 and the second fastener 150*b* is coupled to the second base 140*b*. Likewise, (i) the third base 140*c* is secured to the third body 132 over the third opening 136 and the third fastener 150*c* is coupled to the third base 140*c*, and (ii) the fourth base 140*d* is secured to the third body 132 over the fourth opening 138 and the fourth fastener 150*d* is coupled to the fourth base 140*d*.

Each of the fasteners 150 is configured (e.g., shaped and sized) to selectively engage (e.g., fasten to, attach to, couple to, and/or otherwise mate) with a corresponding other one of the fasteners 150. In the illustrated embodiment, for example, the first fastener 150*a* is configured to selectively engage the third fastener 150*c* to couple/decouple the first toy component 110 to/from the third toy component 130, and the second fastener 150*b* is configured to selectively engage the fourth fastener 150*d* to couple/decouple the second toy component 120 to/from the third toy component 130. In some embodiments, the fasteners 150 can comprise corresponding commercially available male and female snaps, snap buttons, etc. For example, in the illustrated embodiment the first and second fasteners 150*a*, 150*b* are male snap buttons and the third and fourth fasteners 150*c*, 150*d* are female snap buttons. In some embodiments, the fastener assemblies 170 (e.g., the fasteners 150) are configured to rotatably couple the toy components 110-130 together such that, for example, the first toy component 110 and the second toy component 120 can be independently rotated (e.g., by a user) relative to the third toy component 130.

In some embodiments, some or all of the bases 140 can be generally similar or identical to one another (e.g., including similar or identical features, dimensions, and/or sizes). In the illustrated embodiment, for example, the bases 140 are substantially identical to one another. In other embodiments, the bases 140 can have varying dimensions. For example, the bases 140 can have different dimensions to cover/span openings of varying sizes in the toy components 110-130 while the fasteners 150 attached thereto have substantially identical dimensions. In other embodiments, the bases 140 for male ones of the fasteners 150 (e.g., the first and second fasteners 150*a* and 150*b*) may differ from the bases 140 for female ones of the fasteners 150 (e.g., the third and fourth fasteners 150*c* and 150*d*) to accommodate differences in the dimensions of the male and female fasteners 150.

Figure 2A:
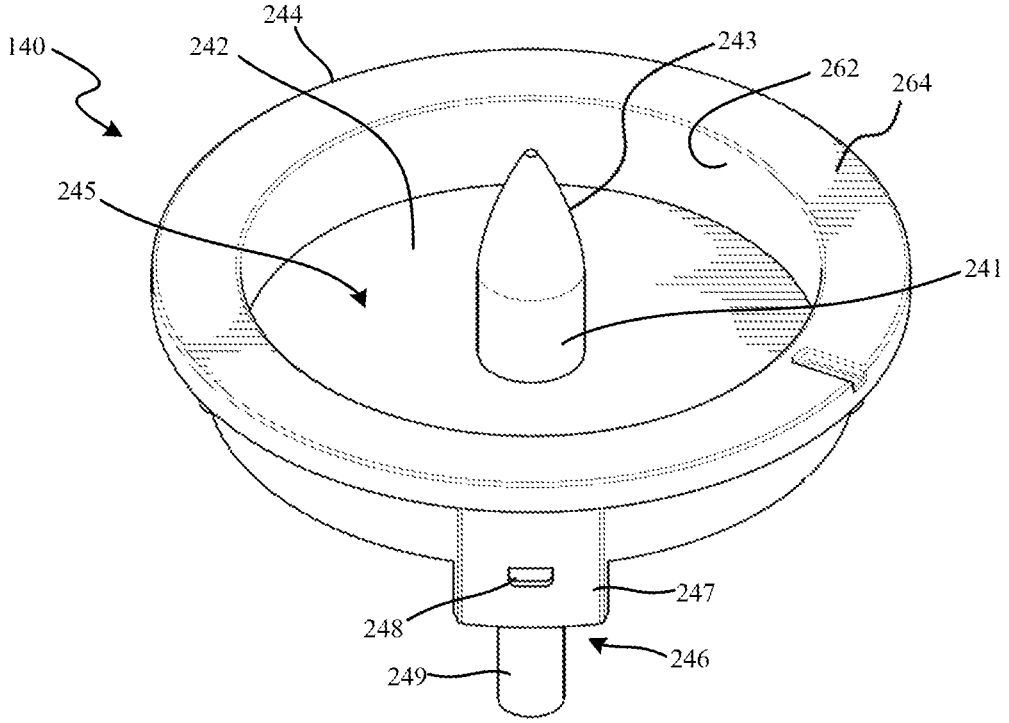
FIGS. 2A and 2B are an isometric front view and an isometric rear view, respectively, of a base of the toy of FIGS. 1A-1C configured in accordance with embodiments of the present technology.
Figure 2B:
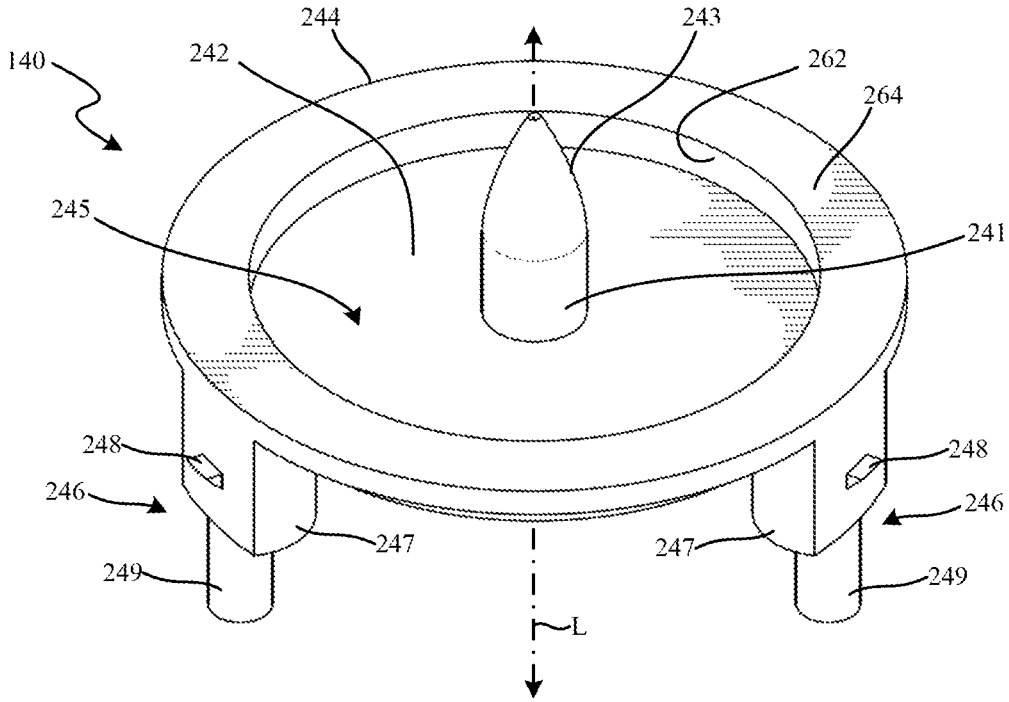

FIGS. 2A and 2B are an isometric front view and an isometric rear view, respectively, of one of the bases 140 configured in accordance with embodiments of the present technology. Referring to FIGS. 2A and 2B together, the base 140 includes a plate portion 242 (e.g., a back plate) and a flange 244 extending from the plate portion 242 (e.g., from an outer perimeter and/or upper surface of the plate portion 242). More specifically, the flange 244 can include (i) a first flange portion 262 projecting from the plate portion 242 in a first direction relative to (e.g., parallel to) a longitudinal axis L (FIG. 2B) of the base 140 and (ii) a second flange portion 264 projecting from the first flange portion 262 in a direction generally perpendicular to the longitudinal axis L. The plate portion 242 and the flange 244 together define a recess 245. In some embodiments, the flange 244 extends entirely around a perimeter (e.g., a circumference) of the plate portion 242. In other embodiments, however, the flange 244 can extend only partially around the perimeter of the plate portion 242. In the illustrated embodiment, the plate portion 242 and the flange 244 have a generally circular cross-sectional shape while, in other embodiments, the plate portion 242 and/or the flange 244 can have other cross-sectional shapes (e.g., rectilinear, polygonal, irregular, etc.). In other embodiments, the plate portion 242 may include one or more perforations.

In the illustrated embodiment, the base 140 further includes a post 241 extending from the plate portion 242 (e.g., from the upper surface of the plate portion 242) in the first direction and having a tapered tip 243. In some embodiments, the post 241 can extend generally along the longitudinal axis L of the base 140. In other embodiments, the post 241 can be off-center relative to the longitudinal axis L. As described in greater detail below with reference to FIGS. 4A-5B, the post 241 is configured to secure a corresponding one of the fasteners 150 (FIGS. 1B and 1C) to the base 140 within the recess 245 (e.g., via a press-fit arrangement).

The base 140 further includes a plurality of legs 246 (e.g., standoffs) extending from the plate portion 242 and/or the flange 244 in a second direction opposite the first direction relative to (e.g., parallel to) the longitudinal axis L. More specifically, for example, the legs 246 can extend from (i) an outer surface of the first flange portion 262 and/or (ii) a lower surface of the second flange portion 264. In the illustrated embodiment, the legs 246 are positioned symmetrically about the longitudinal axis L (e.g., angularly offset by about 120 degrees) and extend beyond a lower surface of the plate portion 242. In some embodiments, the base 140 can include more or fewer of the legs 246 positioned symmetrically or asymmetrically about/around the plate portion 242. The legs 246 can each include (i) a first leg portion 247 extending from the plate portion 242 and/or the flange 244 and having a first cross-sectional shape and dimension (e.g., area, diameter, etc.) and (ii) a second leg portion 249 extending from the first leg portion 247 and having a second cross-sectional shape and dimension. In some embodiments, the first and second cross-sectional shapes and/or dimensions can be different. For example, in the illustrated embodiment the second leg portion 249 has a circular cross-sectional shape, and the first leg portion 247 has a semicircular cross-sectional shape with a larger cross-sectional area than the second leg portion 249. Accordingly, in some embodiments the second leg portion 249 can be a cylindrical post. The legs 246 can further include one or more engagement features 248 (e.g., tabs, tines, etc.) projecting radially outward from the first leg portion 247 (e.g., away from the longitudinal axis L). In other embodiments, the engagement features 248 can extend from the second leg portion 249, and/or the base 140 can include more or fewer of the engagement features 248. In yet other embodiments, engagement features may extend or protrude from the flange 244 of the base 140. The base 140 can be formed from plastic, metal, and/or materials and can be integrally formed (e.g., molded as a single part) or otherwise manufactured.

Referring to FIGS. 1B, 2A, 2B together, the first body 112 of the first toy component 110 incudes a plurality of first recesses 115 (e.g., grooves, channels, tunnels, etc.; only one of the first recesses 115 is visible in FIG. 1B) configured to receive and secure therein corresponding ones of the legs 246 of the first base 140*a*. When the legs 246 are positioned in the first recesses 115, the engagement features 248 of the legs 246 can engage the first body 112 (e.g., engage/mate with corresponding features formed in the first recesses 115 in the first body 112) to secure the first base 140*a* to the first body 112. In some embodiments, the legs 246 can be secured in the first recesses 115 with an adhesive, either as an alternative or in addition to the engagement features 248. In some embodiments, the cross-sectional dimensions of the first leg portions 247 are larger than the first recesses 115 such that only the second leg portions 249 extend into the first recesses 115 (e.g., with the first leg portions 247 acting as "stops"). When the first base 140*a* is secured to the first body 112, the plate portion 242 of the first base 140*a* is configured to span across and cover or substantially cover the first opening 116 of the first body 112. In some embodiments, the flange 244 of the first base 140*a* does not contact the first body 112 of the first toy component 110 when the legs 246 are seated in the first recesses 115, resulting in an air gap 117 (FIG. 1B) between the flange 244 and the first body 112. In such embodiments, the first base 140*a* does not close off or seal the first opening 116 in the first body 112. In one aspect of the present technology, this arrangement can enhance sound propagation out of the first body 112.

The second through fourth bases 140*b*-140*d* can be secured to the second and third toy components 120, 130 in a generally similar or identical manner as the first base 140*a* described in detail above. For example, the second toy component 120 can include a plurality of second recesses 125 configured to receive and secure corresponding ones of the legs 246 of the second base 140*b*. Likewise, the third toy component 130 can include (i) a plurality of third recesses 135 configured to receive and secure corresponding ones of the legs 246 of the third base 140*c* and (ii) a plurality of fourth recesses 137 configured to receive and secure corresponding ones of the leas 246 of the fourth base 140*d*.

Figure 3A:
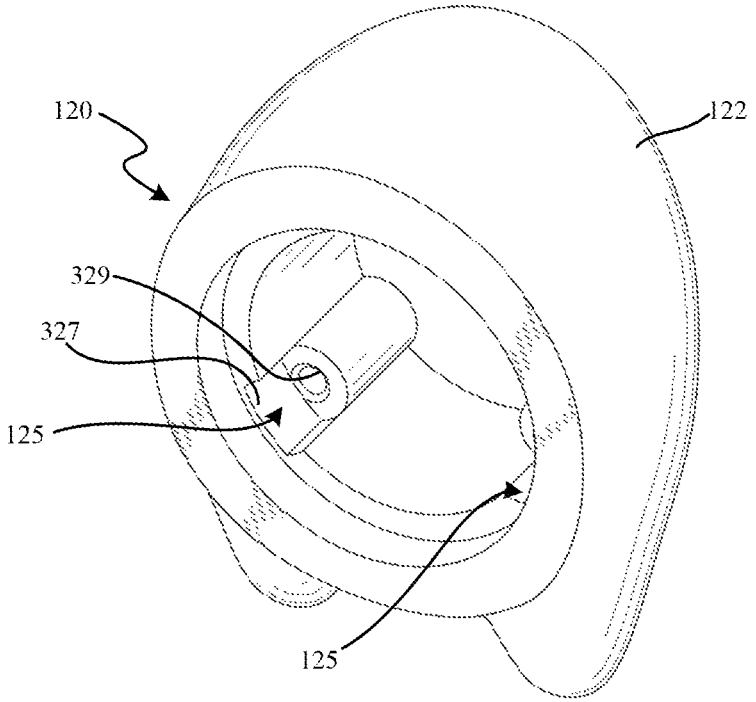
FIGS. 3A and 3B are isometric views of a toy module of the toy of FIGS. 1A-1C before and after installation of a base and a fastener, respectively, in accordance with embodiments of the present technology.
Figure 3B:
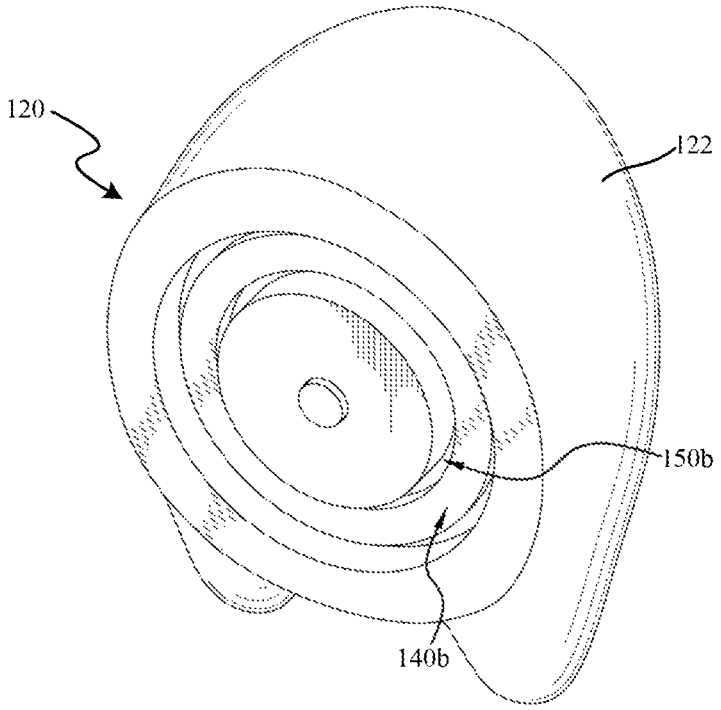

More specifically, for example, FIGS. 3A and 3B are isometric views of the second toy component 120 before and after installation of the second base 140*b* and the second fastener 150*b*, respectively, in accordance with embodiments of the present technology. Referring to FIGS. 2A-3B together, the second recesses 125 in the second body 122 can each include a first recess portion 327 configured to receive a corresponding one of the first leg portions 247 of the second base 140*b* and a second recess portion 329 configured to receive a corresponding one of the second leg portions 249 of the second base 140*b*. In some embodiments, the first recess portion 327 can comprise a generally rectilinear channel that matches the cross-sectional shape of the first leg portions 247. Similarly, the second recess portion 329 can comprise a circular opening/tunnel that generally matches the cross-sectional shapes of the second leg portions 249. The first recesses 115, the third recesses 135, and the fourth recesses 137 can be generally similar or identical as the second recesses 125 described in detail with reference to FIGS. 3A and 3B.

Referring to FIGS. 1B and 2B together, in some embodiments the legs 246 of the bases 140 are the only components of the bases 140 that contact the bodies 112-132 when the bases 140 are installed thereon. That is, the legs 246 can act to "stand-off" the bases 140 (e.g., the flanges 244 and the plate portions 242 of the bases 140) from the bodies 112-132. In one aspect of the present technology, this arrangement is expected to improve the ability of the bases 140 to vibrate when the fasteners 150 are attached to and/or detached from one another. As described in greater detail below, this can amplify a click-like or other sound generated when the fasteners 150 are attached to and/or detached from one another.

Figure 4A:
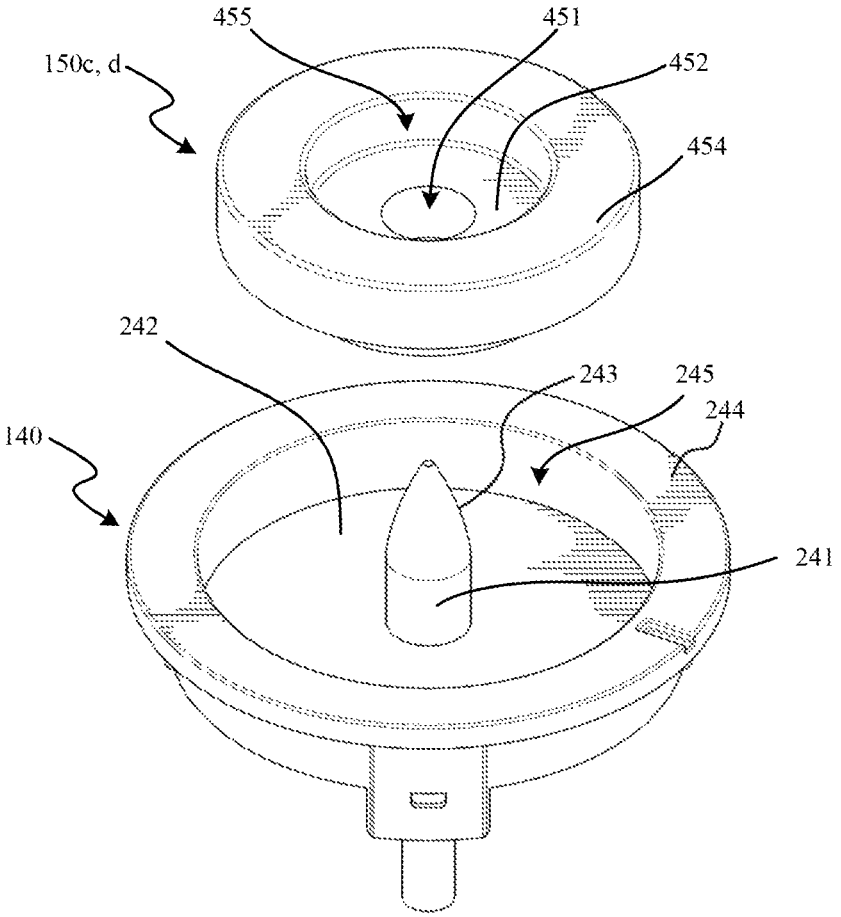
FIGS. 4A and 4B are an isometric view and a partially cross-sectional isometric view, respectively, illustrating the installation of a female fastener onto a base of the toy with interchangeable modules of FIGS. 1A-1C in accordance with embodiments of the present technology.
Figure 4B:
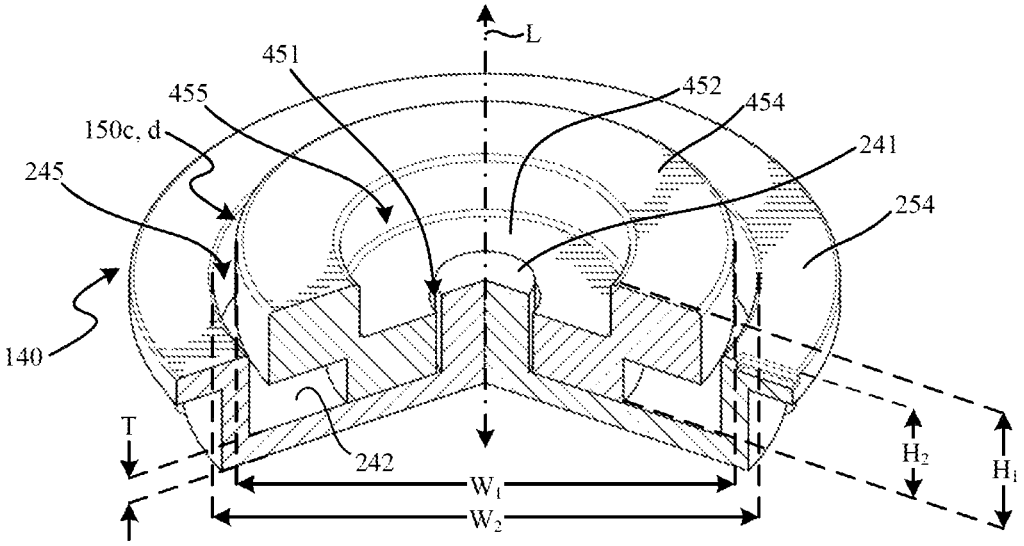

FIGS. 4A and 4B are an isometric view and a partially cross-sectional isometric view, respectively, illustrating the installation of a female one of the fasteners 150 (e.g., the third fastener 150*c* or the fourth fastener 150*d* of FIGS. 1A-1C; referred to herein as "female fastener 150*c, d*") onto one of the bases 140 in accordance with embodiments of the present technology. Referring to FIGS. 4A and 4B together, the female fastener 150*c, d* can include a base portion 452 and a flange 454 projecting from the base portion 452. The base portion 452 and the flange 454 together define a recess 455, and an opening 451 extends through the base portion 452.

The female fastener 150*c, d* can be installed onto the base 140 by pressing (e.g., press-fitting) the female fastener 150*c, d* into the recess 245 of the base 140 and inserting the post 241 through the opening 451. In some embodiments, once the female fastener 150*c, d* is seated in the recess 245 as shown in FIG. 4B, the tip 243 of the post 241 can be removed (e.g., broken off) such that the post 241 does not project into or does not substantially project into the recess 455 of the female fastener 150*c, d*. In other embodiments, the process of seating the female fastener 150*c, d* and removing the tip 243 is substantially simultaneous. In some embodiments, the female fastener 150*c, d* (e.g., a lower surface of the base portion 452) can directly contact the plate portion 242 of the base 140 when it is installed into the recess 245. In other embodiments, an air gap, or a plastic, metal, or other material can be positioned between the plate portion 242 of the base 140 and the female fastener 150*c, d*.

As shown in FIG. 4B, a height $H_1$ of the female fastener 150*c, d* along the longitudinal axis L can be greater than a height $H_2$ of the flange 244 of the base 140 such that female fastener 150*c, d* projects/extends past an upper surface of the flange 244. In other embodiments, however, the height $H_2$ can be greater than the height $H_1$. In some embodiments, an outer width $W_1$ (e.g., in a direction along an axis perpendicular to the longitudinal axis L) of the female fastener 150*c, d* can be less than a width $W_2$ of the recess 245 of the base 140 such that the flange 454 of the female fastener 150*c, d* is spaced apart from the flange 254 of the base 140. In other embodiments, the width $W_1$ can be slightly less than or substantially equal to the width $W_2$ such that the flange 454 of the female fastener 150*c, d* contacts/engages the flange 254 of the base 140. In some embodiments, the plate portion 242 of the base 140 can have a thickness T that is less than the height $H_1$ and/or the height $H_2$. In some embodiments, the thickness T can be selected to enhance sound propagation through/from the toy 100, as described in greater detail below. For example, the thickness T can be selected to generally enhance and/or maximize vibration of the base 140.

Figure 5A:
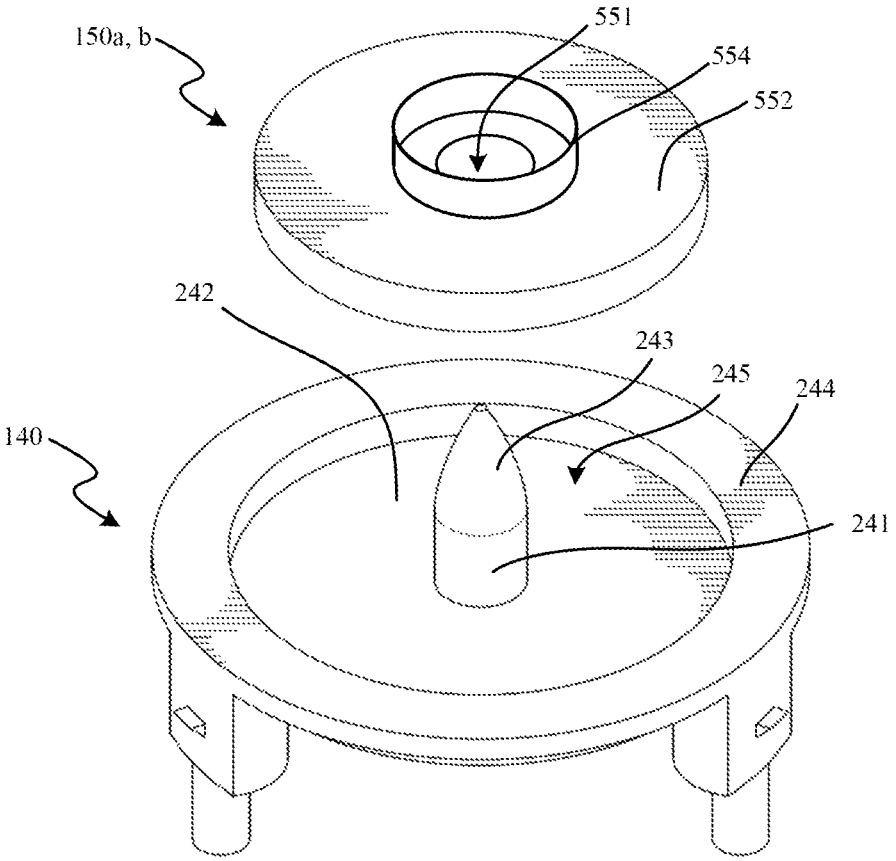
FIGS. 5A and 5B are an isometric view and a partially cross-sectional isometric view, respectively, illustrating the installation of a male fastener onto a base of the toy with interchangeable modules of FIGS. 1A-1C in accordance with embodiments of the present technology.
Figure 5B:
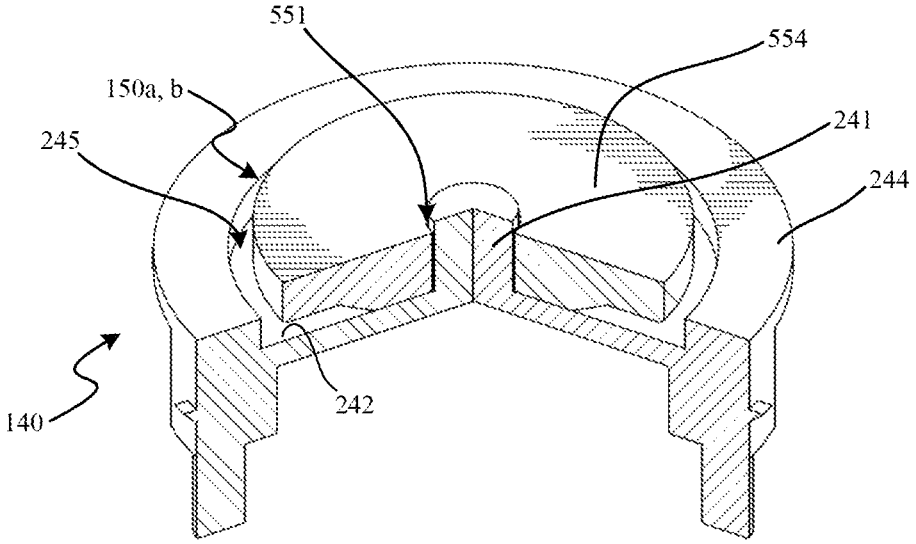

FIGS. 5A and 5B are an isometric view and a partially cross-sectional isometric view, respectively, illustrating the installation of a male one of the fasteners 150 (e.g., the first fastener 150*a* or the second fastener 150*b* of FIGS. 1A-1C; referred to herein as "male fastener 150*a, b*") onto one of the bases 140 in accordance with embodiments of the present technology. Referring to FIGS. 5A and 5B together, the male fastener 150*a, b* can include features generally similar or identical to those of the female fastener 150*c, d* described in detail above with reference to FIGS. 4A and 4B. For example, the male fastener 150*a, b* can include a base portion 552 having an opening 551 therein, and a flange 554 projecting from the base portion 552. The flange 554 is omitted in FIG. 5B for the sake of clarity. The male fastener 150*a, b* can be installed onto the base 140 by pressing the male fastener 150*a, b* into the recess 245 of the base 140 and inserting the post 241 through the opening 551. In some embodiments, once the male fastener 150*a, b* is seated in the recess 245 as shown in FIG. 5B, the tip 243 of the post 241 can be removed (e.g., broken off) such that the post 241 does not project past/beyond or does not substantially project past the base portion 552 of the male fastener 150*a, b* (e.g., past an upper surface thereof). In other embodiments, the process of seating the male fastener 150*a, b* and removing the tip 243 is substantially simultaneous.

Referring to FIGS. 4A-5B together, the flange 554 of the male fastener 150*a, b* is configured (e.g., sized and shaped) to releasably couple to/engage with the flange 454 of the female fastener 150*c, d*. More specifically, the flange 554 of the male fastener 150*a, b* can project into the recess 455 of the female fastener 150*c, d* to secure the components together via various close-fit arrangements known in the art. In some embodiments, the fasteners 150 can be rotatably coupled together. In other embodiments, the fasteners 150 can be secured together using other suitable configurations/arrangements.

Referring to FIGS. 1A-5B together, in some embodiments coupling together and/or decoupling the toy components 110-130 can generate a satisfying audible click-like or other sound via the engagement/disengagement of the fasteners 150. In one aspect of the present technology, this sound is amplified by the configuration and disposition of the bases 140 relative to the toy components 110-130. More specifically, for example, the first base 140*a* spans across the first opening 116 in the first body 112 such that the first fastener 150*a* is positioned substantially or entirely over the first opening 116 and the first chamber 114. Moreover, the first base 140*a* only contacts the first body 112 in the first recesses 115 (e.g., via the legs 246) such that (i) the flange 244 and the plate portion 242 have fewer fixed points of contact and (ii) the air gap 117 exists between the first base 140*a* and the first body 112. Accordingly, when the first fastener 150*a* is coupled to/decoupled from the second fastener 150*b*, acoustic waves generated by the engagement/disengagement of the fasteners 150 can propagate through the first base 140*a* and into the first chamber 114 where the acoustic waves can be reflected out of the first toy component 110 through, for example, the air gap 117. Additionally, in some embodiments the thickness T of the first base 140*a* can be selected to generally maximize vibration of the first base 140*a* and therefore sound transfer into/from the first chamber 114. The arrangement of the second through fourth bases 140*b-d* and the second through fourth fasteners 150*b*-150*d* can be generally similar or identical to that of the first base 140*a* and first fastener 150*a* described in detail above. Thus, the modular toy 100 can generate relatively loud sounds that may be satisfying to a user when the user selectively attaches or detaches the toy components 110-130 from one another.

The following examples are illustrative of several embodiments of the present technology:

1. A toy component, comprising:
   a body having an opening;
   a base including (a) a plate portion configured to be positioned over the opening, (b) a flange portion extending from the plate portion, and (c) a leg extending past a lower surface of the plate portion, wherein the plate portion and the flange portion together define a recess, and wherein the leg is configured to be coupled to the body; and
   a fastener positioned in the recess, wherein the fastener is configured to generate sound when the fastener is engaged with or disengaged from another fastener.
2. The toy component of example 1 wherein the body includes a chamber that reflects sound.
3. The toy component of example 1 or example 2, further comprising an air gap between the base and the body.
4. The toy component of any one of examples 1-3 wherein the base further includes a post extending from the plate portion away from the opening, and wherein the fastener is secured to the post.

5. The toy component of any one of examples 1-4 wherein the recess is a first recess, wherein the body further defines a second recess, and wherein the leg of the base is configured to be positioned in the second recess.

6. The toy component of example 5 wherein the leg includes an engagement feature projecting therefrom and configured to engage the body within the second recess.

7. The toy component of any one of examples 1-6 wherein the fastener is positioned on the plate portion over the opening.

8. The toy component of any one of examples 1-7 wherein the fastener has a first thickness greater than a second thickness of the plate portion of the base.

9. The toy component of any one of examples 1-8 wherein the leg is the only portion of the base that contacts the body when the base is coupled to the body.

10. The toy component of any one of examples 1-9 wherein the leg is one of a plurality of legs, wherein each of the legs is configured to be coupled to a corresponding recessed portion of the body, and wherein the legs are the only portion of the base that contacts the body when the base is coupled to the body.

11. A base for retaining a fastener, the base comprising:

a plate portion having an upper surface and a lower surface;

a flange extending from the plate portion in a first direction, wherein the plate portion and the flange together define a recess for receiving at least a portion of the fastener; and a leg extending from the flange in a second direction opposite the first direction, wherein the leg extends past the lower surface of the plate portion.

12. The base of example 11 wherein the flange includes a first flange portion extending in the first direction, and a second flange portion extending in a second direction generally perpendicular to the first flange portion.

13. The base of example 11 or example 12 wherein the leg includes a first leg portion extending from the flange and a second leg portion extending from the first leg portion, wherein the first leg portion has a larger cross-sectional area than the second leg portion.

14. The base of any one of examples 11-13 wherein the leg includes a first leg portion extending from the flange and a second leg portion extending from the first leg portion, wherein the first leg portion has a different cross-sectional shape than the second leg portion.

15. The base of example 14 wherein the second leg portion has a circular cross-sectional shape.

16. The base of any one of examples 11-15, further comprising a post extending from the plate portion in the first direction, wherein the post is configured to be positioned in a corresponding opening in the fastener to retain the fastener in the recess.

17. The base of any one of examples 11-16 wherein the leg includes an engagement feature projecting therefrom.

18. A toy having interchangeable components, comprising:

a plurality of toy components, wherein each toy component includes— a body having an opening;

a base including (a) a plate portion configured to be positioned over the opening, (b) a flange extending from the plate portion, and (c) a leg extending past a lower surface of the plate portion, wherein the plate portion and the flange of the base together define a recess, and wherein the leg of the base is configured to be coupled to the body;

a first fastener positioned in the recess of at least one of the plurality of toy components;

a second fastener positioned in the recess of at least one other of the plurality of toy components; and an air gap between the base and the body, wherein the first fastener is configured to be releasably coupled to the second fastener to releasably couple the at least one of the plurality of toy components to the at least one other of the plurality of toy components.

19. The toy of example 18 wherein the first and second fasteners are configured to generate a sound when the first and second fasteners are coupled to or decoupled from one another, wherein the body defines a sound-reflecting chamber, and wherein the sound-reflecting chamber reflects an audible sound.

20. The toy of example 18 or example 19 wherein each of the plurality of toy components are independently rotatable relative to one another.

21. A base for a fastener, comprising:

a backplate;

a wall extending from an edge of the backplate in a first direction;

a flange extending from an end of the wall in a second direction substantially perpendicular to the first direction; and a standoff disposed on an outer surface of the wall and on a lower surface of the, wherein the standoff extends past a lower surface of the backplate in the first direction.

22. The base of example 21 wherein the standoff comprises an upper and a lower segment.

23. The base of example 21 or example 22 wherein a cross-sectional area of the lower segment is smaller than a cross-sectional area of the upper segment.

24. The base of any one of examples 21-23 wherein the lower segment is a cylindrical post.

25. The base of any one of examples 21-24 wherein the standoff comprises a retention tab.

26. The base of example 25 wherein the retention tab extends from the standoff in the second direction.

27. The base of any one of examples 21-26, further comprising a post extending in the first direction from an upper surface of the backplate.

28. The base of example 27 wherein the post comprises a tapered end.

29. A fastener assembly, comprising:

an annular fastener component having a central opening; and a base comprising— a backplate;

a wall extending from an edge of the backplate in a first direction;

a flange extending from an end of the wall in a second direction substantially perpendicular to the first direction; and a standoff disposed on an outer surface of the wall and on a lower surface of the flange, wherein the standoff extends past a lower surface of the backplate in the first direction, wherein the backplate, wall and flange define an inner recess of the base, and wherein the annular fastener component is disposed in the inner recess.

30. The fastener assembly of example 29, further comprising a post extending in the first direction from an upper surface of the backplate.

31. The fastener assembly of example 30 wherein the post comprises a tapered end.

32. The fastener assembly of example 31 wherein the annular fastener component is press fit onto the post of base.

33. A toy housing assembly, comprising:

a housing defining a sound reflecting area; and a fastener assembly comprising an annular fastener component having a central opening; and a base comprising— a backplate;

a wall extending from an edge of the backplate in a first direction;

a flange extending from an end of the wall in a second direction substantially perpendicular to the first direction; and a standoff disposed on an outer surface of the wall and on a lower surface of the flange, wherein the standoff extends past a lower surface of the backplate in the first direction, wherein the backplate, wall and flange define an inner recess of the base, and wherein the annular fastener component is disposed in the inner recess.

34. The toy housing assembly of example 33 wherein the standoff comprises an upper and a lower segment, and a cross-sectional area of the lower segment is smaller than a cross-sectional area of the upper segment.

35. The toy housing assembly of example 33 or example 34 wherein the lower segment is a post.

36. The toy housing assembly of any one of examples 33-35 wherein the housing defines a recess, and wherein the standoff is disposed on or in the recess.

37. The toy housing assembly of example 36 wherein the recess comprises a slot, and wherein the post is disposed in the slot.

38. The toy housing assembly of example 37 wherein the slot is circular.

39. A toy assembly comprising:

a first housing assembly comprising— a housing defining a sound reflecting area; and a female fastener assembly comprising an annular female fastener component having a central opening; and a base comprising— a backplate;

a wall extending from an edge of the backplate in a first direction;

a flange extending from an end of the wall in a second direction substantially perpendicular to the first direction; and a standoff disposed on an outer surface of the wall and on a lower surface of the flange, and wherein the standoff extends past a lower surface of the backplate in the first direction, wherein the backplate, wall and flange define an inner recess of the base, and wherein the annular fastener component is disposed in the inner recess, and a second housing assembly comprising— a housing defining a sound reflecting area; and a male fastener assembly comprising an annular male fastener component having a central opening; and a base comprising— a backplate;

a wall extending from an edge of the backplate in a first direction;

a flange extending from an end of the wall in a second direction substantially perpendicular to the first direction; and a standoff disposed on an outer surface of the wall and on a lower surface of the flange, and wherein the standoff extends past a lower surface of the backplate in the first direction, wherein the backplate, wall and flange define an inner recess of the base, and wherein the annular fastener component is disposed in the inner recess, wherein the first housing assembly and the second housing assembly are removably attached in a first direction through the male fastener assembly and the female fastener assembly, and wherein the first housing assembly and the second housing assembly rotate independently around an axis defined by the first direction.

40. The toy assembly of example 39 wherein an audible snapping sound is heard when the first housing assembly and the second housing assembly are disengaged.

41. A method of retaining a fastener base in a housing comprising:

forming a housing defining a sound reflecting area; and forming a base comprising— a backplate;

a wall extending from an edge of the backplate in a first direction;

a flange extending from an end of the wall in a second direction substantially perpendicular to the first direction; and a standoff disposed on an outer surface of the wall and on a lower surface of the flange, wherein the standoff comprises an upper and a lower segment, and a cross-sectional area of the lower segment is smaller than a cross-sectional area of the upper segment, wherein the standoff extends past a lower surface of the backplate in the first direction, wherein the backplate, wall and flange define an inner recess of the base, and wherein the annular fastener component is disposed in the inner recess;

forming, in the housing, a recess conforming to the standoff;

forming, in the recess, a slot for the lower segment, disposing the standoff on or in the recess; and disposing the lower segment in the slot.

42. The method of example 41 wherein the standoff further comprises a retention tab extending in the second direction, further comprising forming, in the recess, an opening conforming to the retention tab and inserting, into the opening, the retention tab wherein the retention tab prevents the base from transforming in the first direction.

The above detailed description of embodiments of the technology are not intended to be exhaustive or to limit the technology to the precise form disclosed above. Although specific embodiments of, and examples for, the technology are described above for illustrative purposes, various equivalent modifications are possible within the scope of the technology as those skilled in the relevant art will recognize. For example, although steps are presented in a given order, alternative embodiments may perform steps in a different order. The various embodiments described herein may also be combined to provide further embodiments.

From the foregoing, it will be appreciated that specific embodiments of the technology have been described herein for purposes of illustration, but well-known structures and functions have not been shown or described in detail to avoid unnecessarily obscuring the description of the embodiments of the technology. Where the context permits, singular or plural terms may also include the plural or singular term, respectively.

Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same feature and/or additional types of other features are not precluded. It will also be appreciated that specific embodiments have been described herein for purposes of illustration, but that various modifications may be made without deviating from the technology. Further, while advantages associated with some embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

I claim:

1. A toy component comprising:

a body having an opening;

a base including (a) a plate portion configured to be positioned over the opening, (b) a flange portion extending from the plate portion, and (c) a leg extending past a lower surface of the plate portion, wherein the plate portion and the flange portion together define a recess, and wherein the leg is configured to be coupled to the body;

an air gap between the base and the body; and a fastener positioned in the recess, wherein the fastener is configured to generate sound when the fastener is engaged with or disengaged from another fastener.

2. The toy component of claim 1 wherein the body includes a chamber that reflects sound.

3. The toy component of claim 2 wherein the body includes a plastic material that defines the chamber.

4. The toy component of claim 1 wherein the base further includes a post extending from the plate portion away from the opening, and wherein the fastener is secured to the post.

5. The toy component of claim 1 wherein the recess is a first recess, wherein the body further defines a second recess, and wherein the leg of the base is configured to be positioned in the second recess.

6. The toy component of claim 1 wherein the leg includes an engagement feature projecting therefrom and configured to engage the body within the second recess.

7. The toy component of claim 1 wherein the fastener is positioned on the plate portion over the opening.

8. The toy component of claim 1 wherein the fastener has a first thickness greater than a second thickness of the plate portion of the base.

9. The toy component of claim 1 wherein the leg is the only portion of the base that contacts the body when the base is coupled to the body.

10. The toy component of claim 1 wherein the leg is one of a plurality of legs, wherein each of the legs is configured to be coupled to a corresponding recessed portion of the body, and wherein the legs are the only portion of the base that contacts the body when the base is coupled to the body.

11. The toy component of claim 1 wherein the base and the body are independently rotatable relative to one another.

12. A base for retaining a fastener, the base comprising:

a plate portion having an upper surface and a lower surface;

a flange extending from the plate portion in a first direction, wherein the plate portion and the flange together define a recess for receiving at least a portion of the fastener; and a leg extending from the flange in a second direction opposite the first direction, wherein the leg extends past the lower surface of the plate portion, wherein the leg includes a first leg portion extending from the flange and a second leg portion extending from the first leg portion, and wherein the first leg portion has a larger cross-sectional area than the second leg portion.

13. A base for retaining a fastener, the base comprising:

a plate portion having an upper surface and a lower surface;

a flange extending from the plate portion in a first direction, wherein the plate portion and the flange together define a recess for receiving at least a portion of the fastener; and a leg extending from the flange in a second direction opposite the first direction, wherein the leg extends past the lower surface of the plate portion, wherein the leg includes a first leg portion extending from the flange and a second leg portion extending from the first leg portion, and wherein the first leg portion has a different cross-sectional shape than the second leg portion.

14. The base of claim 13 wherein the flange includes a first flange portion extending in the first direction, and a second flange portion extending in a second direction generally perpendicular to the first flange portion.

15. The base of claim 13 wherein the second leg portion has a circular cross-sectional shape.

16. The base of claim 13, further comprising a post extending from the plate portion in the first direction, wherein the post is configured to be positioned in a corresponding opening in the fastener to retain the fastener in the recess.

17. The base of claim 13 wherein the leg includes an engagement feature projecting therefrom.

18. A toy having interchangeable components, comprising:

a plurality of toy components, wherein each toy component includes— a body having an opening;

a base including (a) a plate portion configured to be positioned over the opening, (b) a flange extending from the plate portion, and (c) a leg extending past a lower surface of the plate portion, wherein the plate portion and the flange of the base together define a recess, and wherein the leg of the base is configured to be coupled to the body;

a first fastener positioned in the recess of at least one of the plurality of toy components;

a second fastener positioned in the recess of at least one other of the plurality of toy components; and an air gap between the base and the body, wherein the first fastener is configured to be releasably coupled to the second fastener to releasably couple the at least one of the plurality of toy components to the at least one other of the plurality of toy components.

19. The toy of claim 18 wherein the first and second fasteners are configured to generate a sound when the first and second fasteners are coupled to or decoupled from one another, wherein the body defines a sound-reflecting chamber, and wherein the sound- reflecting chamber reflects an audible sound.

20. The toy of claim 18 wherein each of the plurality of toy components are independently rotatable relative to one another.

* * * * *